US005465030A

United States Patent [19]

Smith

[11] Patent Number: 5,465,030

[45] Date of Patent: Nov. 7, 1995

[54] TRIGGER APPARATUS FOR SPARK GAP DISCHARGERS

[75] Inventor: Brian G. Smith, Crofton, Md.

[73] Assignee: The United States of America as represented by the Secretary of the Army, Washington, D.C.

[21] Appl. No.: 376,192

[22] Filed: Jan. 20, 1995

[51] Int. Cl.[6] ..... H01J 11/04

[52] U.S. Cl. ..... 315/349; 315/209 M; 315/111.01; 315/111.31; 315/111.71; 315/231.41; 315/231.51; 315/631

[58] Field of Search ..... 315/349, 209 CD, 315/209 T, 209 M, 209 SC, 209 P2, 241 P, 241 R, 111.01, 111.11, 111.21, 111.31, 111.41, 111.51, 111.61, 111.71, 111.81, 111.91; 313/307, 308, 325, 231.01, 231.41, 231.71, 581, 631

[56] References Cited

U.S. PATENT DOCUMENTS

| | | | |
|---|---|---|---|
| 2,875,558 | 2/1959 | Mizui | 67/31 |
| 2,935,648 | 5/1960 | Buntenbach | 315/173 |
| 3,211,940 | 10/1965 | Hueschen | 313/205 |
| 3,323,002 | 5/1967 | Lafferty | 315/36 |
| 3,518,484 | 6/1970 | Maskell | 315/111.81 |
| 3,566,184 | 2/1971 | Maskell | 315/111.81 |
| 3,715,614 | 2/1973 | Linkroum | 313/183 |
| 3,798,461 | 3/1974 | Edson | 307/106 |
| 4,126,808 | 11/1978 | Rich | 313/198 |
| 4,527,044 | 7/1985 | Bruel et al. | 315/111.91 |
| 4,538,088 | 8/1985 | Malone | 313/325 |
| 4,604,554 | 8/1986 | Wootton | 313/307 |
| 5,264,895 | 11/1993 | Takahashi et al. | 354/415 |

OTHER PUBLICATIONS

Investigations Into Alternate Spark Gap Switching Techniques Brian G. Smith, Sep. 1994.

*Primary Examiner*—Robert J. Pascal
*Assistant Examiner*—Reginald A. Ratliff
*Attorney, Agent, or Firm*—Freda L. Krosnick; Frank J. Dynda

[57] ABSTRACT

An improved means for triggering high voltage spark gap devices for current injection and pulse power applications which utilizes the high voltage source itself to trigger the discharge. A switch initially directs current flow from the high voltage source through a trigger resistor which creates sufficient potential difference between a primary electrode and the trigger electrode to fire the spark gap. A second blocking resistor inhibits current flow through the trigger electrode and directs the discharge through the load. The trigger circuit has very little influence on the discharge waveform due to the very high impedance of the resistor string.

1 Claim, 3 Drawing Sheets

TRIGGER APPARATUS FOR SPARK GAP DISCHARGERS

GOVERNMENTAL INTEREST

The invention described herein may be manufactured, used, and licensed by or for the United States government without payment to me of any royalty thereon.

TECHNICAL FIELD

The present invention relates to triggered spark gap dischargers, and more particularly to a high impedance trigger device for firing spark gap dischargers.

BACKGROUND ART

Triggered spark gap devices are arc discharge tubes which are utilized as high voltage switches. These tubes contain a pair of opposing dome electrodes, functioning as the contacts of the switch, which are spaced far enough apart to remain insulated from each other and maintain a potential difference of thousands of volts. A trigger electrode protrudes just through, and is insulated from, a hole in one of the dome electrodes. When the spark gap is to be switched, a trigger pulse is applied between the trigger electrode and the dome electrode through which it protrudes. This trigger pulse creates a spark, resulting in a breakdown or ionization of the gas contained within the tube, which then serves as a conductor between the two dome electrodes and effectively closes the switch.

The currently available trigger generating equipment is complex and usually only two to four spark gaps are triggered by a single trigger source.

DISCLOSURE OF THE INVENTION

The present invention discloses an improved means for triggering high voltage spark gap devices for current injection and pulse power applications which utilizes the high voltage source itself to trigger the discharge. A switch initially directs current flow from the high voltage source through a resistor string, comprised of a trigger resistor and a limiting resistor, which creates sufficient potential difference between a primary electrode and the trigger electrode to fire the spark gap. The limiting resistor inhibits current flow through the trigger electrode and allows the current to discharge through the load. The trigger circuit has very little influence on the discharge waveform due to the very high impedance of the resistor string.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
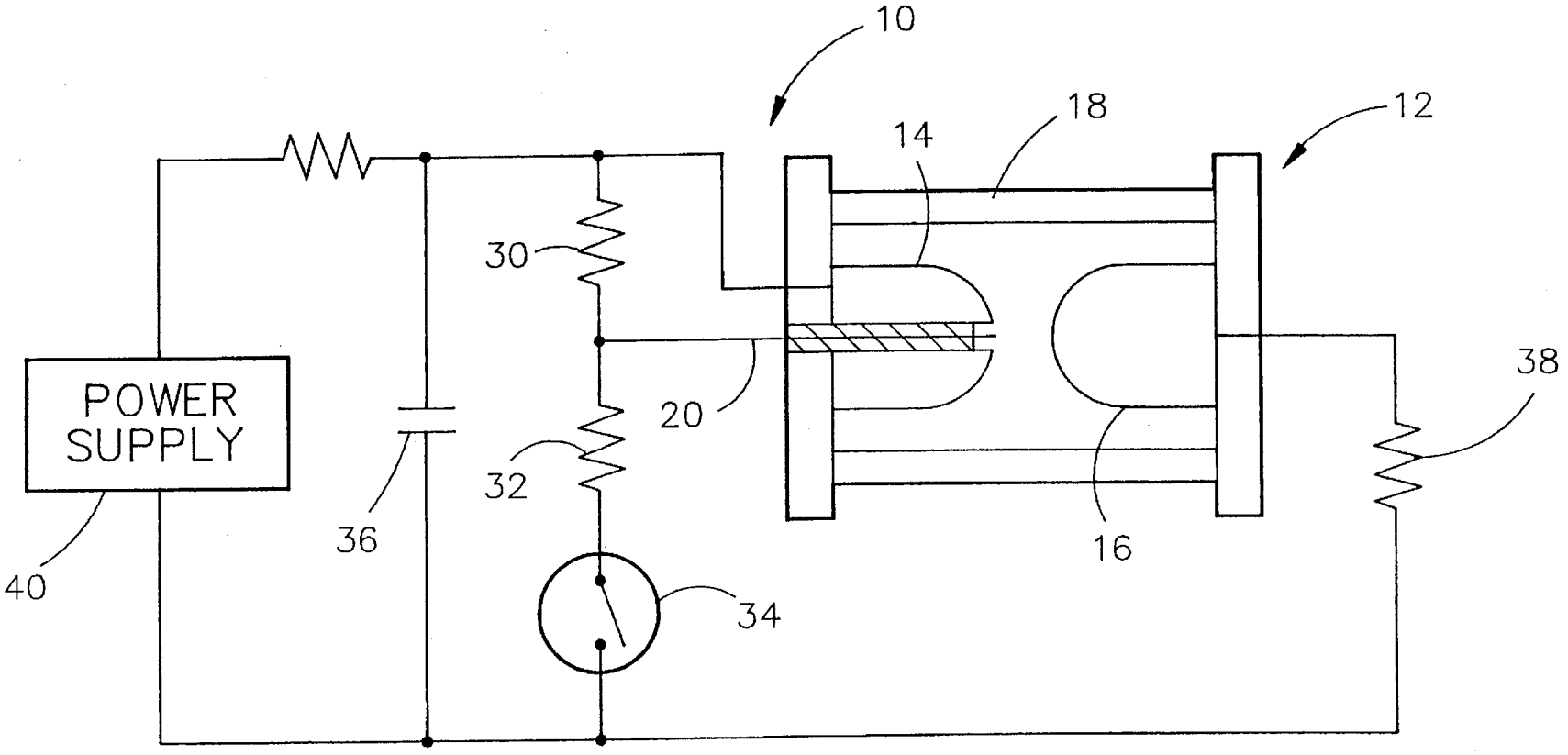
FIG. 1 depicts a single spark gap discharger employing the present invention.

Referring now to the drawings, wherein like reference numerals designate identical or corresponding parts throughout the several views, a high voltage discharge circuit employing the present invention is depicted at 10 in FIG. 1. A spark gap discharge tube 12, well known in the art, employs a pair of primary, dome shaped electrodes 14, 16 which are held in a spaced apart relationship within an insulated cylindrical body 18 which contains gas capable of ionization. A third electrode 20, called the trigger electrode, extends within but is insulated from one of the primary electrodes 14. The two primary dome electrodes 14, 16 function like the contacts of a switch, while the trigger electrode 20 functions to close the switch. When the spark gap discharge tube 12 is to be switched, a potential difference must be applied between the trigger electrode 20 and the primary electrode 14, thereby creating a spark which serves to break down or ionize the gas within the tube. This ionized gas serves as a conductor, essentially closing the switch between the two primary electrodes 14, 16.

The trigger mechanism of the present invention utilizes a trigger resistor 30 in series with a limiting resistor 32 and a high voltage switch 34. In a representative embodiment, the trigger resistor 30 could be 2 Megohms, with a limiting resistor 32 of 200 kilohms. The high voltage switch 34 could be a high voltage relay, a Field Effect Transistor, or other appropriate device. As clearly seen in FIG. 1, the trigger resistor 30 is connected between the primary electrode 14 and the trigger electrode 20, with the limiting resistor 32 connected between the trigger electrode and the high voltage switch 34. Also depicted is a load resistor 38 of perhaps 100 ohms.

The invention functions as follows. A high voltage device requiring discharge, in this instance a capacitor 36, has been charged to 10,000 volts by a power supply 40. With switch 34 open, there is no current flow in the device, although there is a potential difference of 10,000 volts between the primary electrodes 14, 16 and across the contacts of the high voltage switch 34. When switch 34 is closed, an initial current of 4.5 milliamps will flow through the resistor string, creating a potential difference of 9,000 volts across the trigger resistor 30 and therefore between the primary electrode 14 and trigger electrode 20. This voltage is sufficient to cause arcing between the primary electrode 14 and the trigger electrode 20, which in turn ionizes the gas within the tube 12. As discussed above, ionization of the gas, or "breakdown", effectively closes the spark gap switch allowing the capacitor 36 to discharge through the load 38. In this case the discharge current would be approximately 100 amperes. The limiting resistor 32 effectively blocks current flow between the primary electrode 14 and the trigger electrode 20, in this case limiting it to 50 milliamps.

Figure 2:
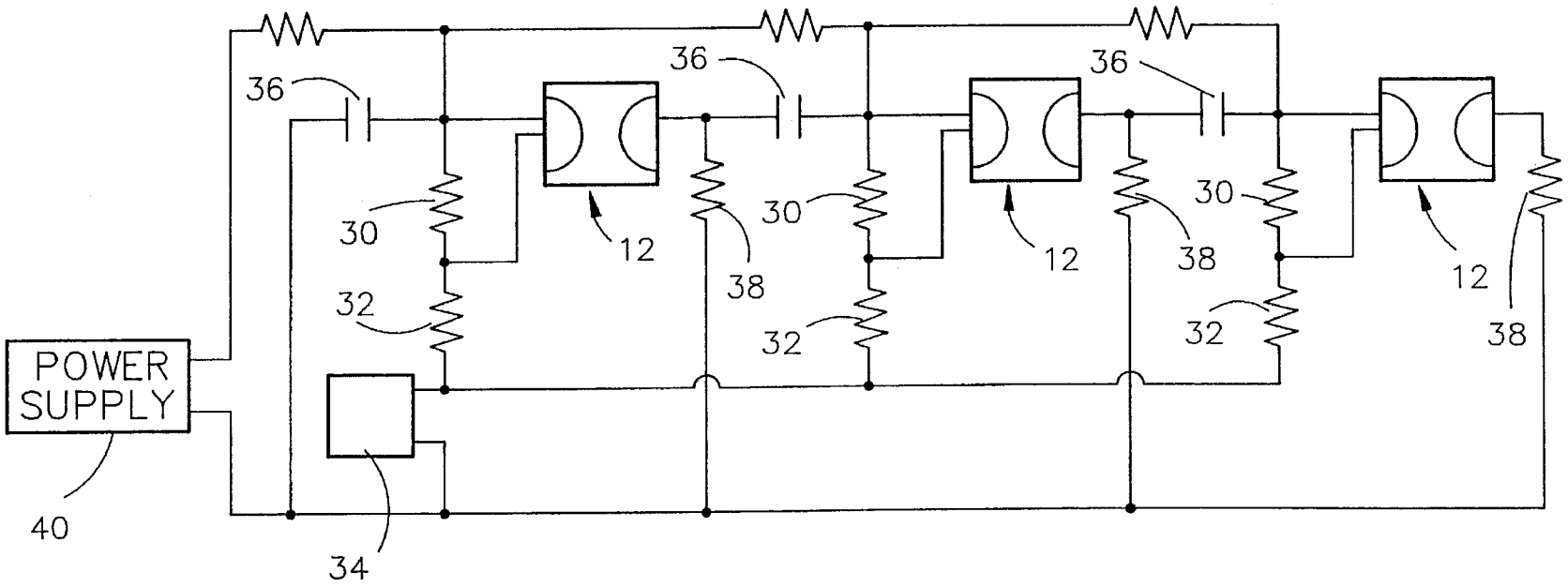
FIG. 2 depicts three spark gap dischargers connected in series utilizing the present invention.
Figure 3:
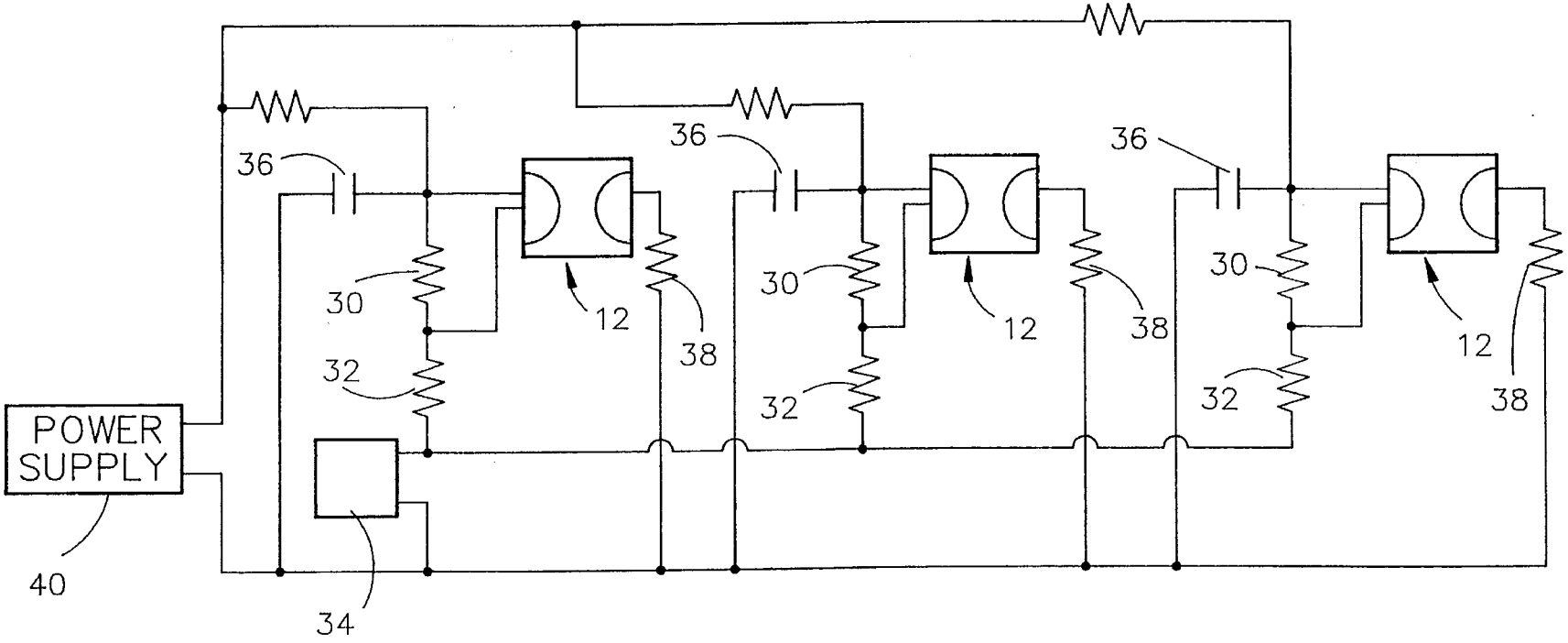
FIG. 3 depicts three spark gap dischargers connected in parallel utilizing the present invention.

FIG. 2 and FIG. 3 depict three spark gap dischargers, connected in series and parallel respectively, which are to be fired simultaneously by a single relay. Such circuits allow the simultaneous firing of twenty or more spark gap dischargers.

Obviously, many modifications and variations of the present invention are possible in light of the above teachings. It is therefore to be understood that, within the scope of the appended claims, the invention may be practiced otherwise than as specifically described.

What is claimed is:

1. A trigger apparatus for a high voltage source spark gap discharger, comprising:

(a) an arc discharge tube having a first and a second primary electrode and a trigger electrode; and (b) a switch, a trigger resistor and a limiting resistor in series with said high voltage source, said trigger resistor in parallel with said first primary electrode and said trigger electrode.

* * * * *